US006629387B2

(12) United States Patent
Whitley et al.

(10) Patent No.: US 6,629,387 B2
(45) Date of Patent: Oct. 7, 2003

(54) SECTIONAL UPWARD ACTING DOOR AND METHOD OF ASSEMBLY

(75) Inventors: L. Blake Whitley, Arlington, TX (US); Charles C. Blume, Euless, TX (US); James Wendall Compton, Roanoke, TX (US); Henri M. Friloux, Plano, TX (US); Robert K. Wright, Rowlett, TX (US)

(73) Assignee: Overhead Door Corporation, Dallas, TX (US)

( * ) Notice: Subject to any disclaimer, the term of this patent is extended or adjusted under 35 U.S.C. 154(b) by 0 days.

(21) Appl. No.: 09/910,992

(22) Filed: Jul. 23, 2001

(65) Prior Publication Data

US 2003/0014940 A1 Jan. 23, 2003

(51) Int. Cl.[7] ..... E04B 1/346; E04B 7/16
(52) U.S. Cl. ..... 52/64; 160/201; 160/229.1
(58) Field of Search ..... 160/201, 229.1, 160/236; 16/225, 257, 267, 387; 52/640

(56) References Cited

U.S. PATENT DOCUMENTS

| | | | | |
|---|---|---|---|---|
| 2,732,581 | A | 1/1956 | Heck | |
| 3,103,967 | A | 9/1963 | Gaschen | |
| 4,893,666 | A | 1/1990 | Hörmann | |
| 5,002,114 | A | 3/1991 | Hörmann | |
| 5,170,832 | A | 12/1992 | Wagner | |
| 5,522,446 | A | 6/1996 | Mullet et al. | |
| 5,553,651 | A | 9/1996 | Olsen | |
| 5,622,012 | A | 4/1997 | Schijf | |
| 5,626,176 | A | 5/1997 | Lewis, Jr. et al. | |
| 5,669,431 | A | 9/1997 | Druzynski et al. | |
| 5,782,283 | A | 7/1998 | Kendall | |
| 5,913,352 | A | 6/1999 | Scates et al. | |
| 5,915,444 | A | 6/1999 | Sastri et al. | |
| 5,921,307 | A | 7/1999 | Ford et al. | |
| 5,927,369 | A | 7/1999 | Pedersen | |
| 5,934,352 | A | 8/1999 | Morgan | |
| 5,992,497 | A | 11/1999 | Jaehnen et al. | |
| 6,006,817 | A | 12/1999 | Stone et al. | |
| 6,047,761 | A | 4/2000 | Jaehnen et al. | |
| 6,098,697 | A | 8/2000 | Krupke et al. | |
| 6,408,926 | B1 * | 6/2001 | Hoofard et al. | 160/236 |
| 6,328,091 | B1 * | 12/2001 | Whitley | 160/201 |

* cited by examiner

*Primary Examiner*—Carl D. Friedman
*Assistant Examiner*—Yvonne M. Horton
(74) *Attorney, Agent, or Firm*—Gardere Wynne Sewell LLP

(57) ABSTRACT

Sectional door panels include formed metal or plastic skin parts with opposed upper and lower edges configured to form pinch resistant connections between adjacent panels. The skin part edges include spaced-apart slots for receiving locating flanges formed on opposed end stiles and one or more intermediate stiles to provide for the stiles to be positively located with respect to the panel skin part during assembly thereof. Snap together hinge parts are provided with bosses cooperating with slots formed in the stiles for positively locating the hinge parts with respect to the stiles and the skin part. Mechanical fasteners connect the hinge parts and the stiles to the skin parts. The hinge parts include cooperating pin and pin receiving bore portions with the bore portions being formed in part by elastically deflectable fingers whereby the hinge parts may be snapped together during assembly of the door by stacking one panel on top of another.

22 Claims, 12 Drawing Sheets

SECTIONAL UPWARD ACTING DOOR AND METHOD OF ASSEMBLY

BACKGROUND OF THE INVENTION

In the continuing development of upward acting sectional doors, the need persists, in particular, for door panel construction and methods of assembly which satisfy all of the criteria for residential and commercial sectional doors with respect to performance, durability, manufacturing cost and ease of assembly. In the last mentioned regard a need has continued to exist for sectional door panels which may be fabricated conveniently and rapidly at the location of manufacture and assembly of the respective panels while maintaining accurate positioning of hinge components on the panels and while also providing panels which may be conveniently interconnected to each other at the point of installation of the door. For example, door assembly and installation procedures are improved if the door installer is not required to attach hinge components to the respective panels at the location of door installation. Accordingly, it is desirable to be able to accurately preassemble hinge components on the respective panels at the location of panel fabrication.

Conventional materials used for the manufacture of sectional upward acting doors include formed sheet metal parts which comprise the panel skin as well as the reinforcing members connected to the skin, commonly known as stiles. The need has persisted for sectional door panel construction wherein the rolled or otherwise formed metal or plastic skin members may be quickly and accurately connected to the reinforcing stile members and whereby the stile members are properly located and are also adapted to support door guide members and hinge components. In this last mentioned regard, the accurate positioning of cooperating hinge members on each of the door panels is important, particularly for door panels which are designed to be connected to each other at the point of installation by mounting each of the panels on top of or adjacent each other and between the door guide structure or guide tracks.

The present invention achieves many of the desiderata mentioned above as well as other objectives which will be appreciated by those skilled in the art.

BRIEF SUMMARY OF THE INVENTION

The present invention provides an improved panel construction, hinge assembly, method of panel assembly and method of door assembly for a sectional door.

In accordance with one aspect of the present invention, an improved sectional door panel construction is provided by a combination of a rolled metal or plastic or otherwise formed skin part which is cooperable with plural reinforcing members or stiles whereby the skin part and the stiles may be quickly and accurately assembled to each other in proper position of the stiles. The present invention also provides for the stiles to be secured to the skin part with mechanical fasteners which are also operable to secure to the panel respective hinge parts of a hinge assembly for the door.

Further in accordance with the invention, a door panel skin part is provided with respective top and bottom edges which are formed to provide an improved pinch resistant profile and to include stile locating slots. The panel reinforcing stiles are provided with cooperating locating flanges, which are formed by extrusion or punch operations, as well as other locating features, including a plurality of spaced apart clips which are integrally formed with the stiles and are operable to engage the skin part.

Still further, a sectional door panel according to the present invention includes improved hinge members which are adapted to be accurately positioned on the panel and securely fastened thereto during an assembly step which also provides for securing the panel skin part to a stile. Each of the hinge parts includes a locating boss or the like which is operable to be disposed in a slot formed in a panel reinforcing stile which, in turn, has been formed by forming the extruded or punched locating flange.

The present invention further provides improved guide member support brackets which are conveniently and accurately located on opposed panel end stiles and secured thereto in an improved manner.

Still further, the present invention provides an improved sectional door panel hinge assembly including respective hinge parts which are cooperable with each other to provide for connecting the hinge parts and adjacent door panels to each other by merely pushing or snapping the hinge parts into forcible engagement with each other. The panel parts and hinge parts are configured for accurate positioning of the hinge parts on the panels and the hinge parts are advantageously connected to the panels at the location of fabrication of the panels.

In accordance with yet another aspect of the present invention, door panel reinforcing stiles and skin parts are provided which are adapted for quick assembly to each other and are configured to retain the parts in proper position with respect to each other once assembled. Final assembly is provided by securing panel hinge parts to the stiles and the skin part all at substantially the same time to facilitate the speed with which sectional door panels in accordance with the invention may be constructed and subsequently connected to each other at the point of installation.

Those skilled in the art will further appreciate the above-mentioned advantages and superior features of the invention, together with other important aspects thereof upon reading the detailed description which follows in conjunction with the drawings.

DETAILED DESCRIPTION OF THE PREFERRED EMBODIMENTS

Figure 1:
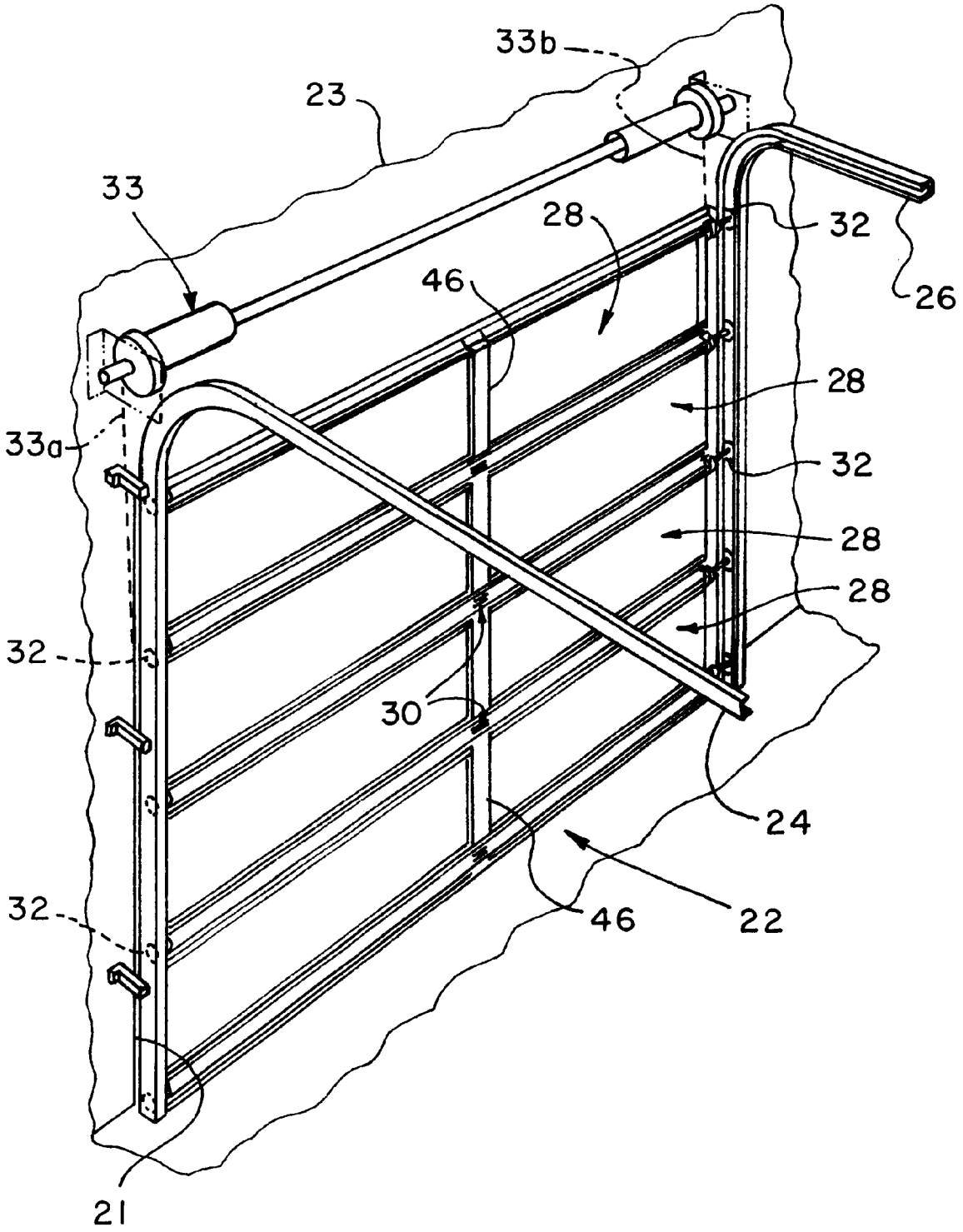
FIG. 1 is perspective view of an upward acting track guided door including the door panel construction and hinge assemblies in accordance with the invention.

In the description which follows, like parts are marked throughout the specification and drawings with the same reference numerals, respectively. The drawing figures are not necessarily to scale and certain features may be shown in somewhat generalized form in the interest of clarity and conciseness.

Referring to FIG. 1, there is illustrated a sectional upward acting door including panels in accordance with the invention, such door generally indicated by the numeral 22. The door 22 is adapted for guidance and support when moved between a closed position, as shown, and an open position with respect to a generally rectangular opening 21 in a wall 23 by opposed somewhat channel shaped guide tracks 24 and 26, which may be of somewhat conventional construction. The door 22 is characterized by plural hingedly interconnected panels 28 which are of substantially identical construction and are interconnected by respective spaced apart hinge assemblies 30 which will be shown and described in further detail herein. The panels 28 are adapted for guidance along and support by the tracks 24 and 26 by conventional roller type guide members 32 which are connected to the respective panels 28 by improved support brackets which will also be described in further detail herein. Door 22 is counterbalanced by a suitable mechanism 33 including depending cables 33*a* and 33*b* which are connected to the lower edge of the lowermost panel 28 at opposite ends thereof.

Figure 2:
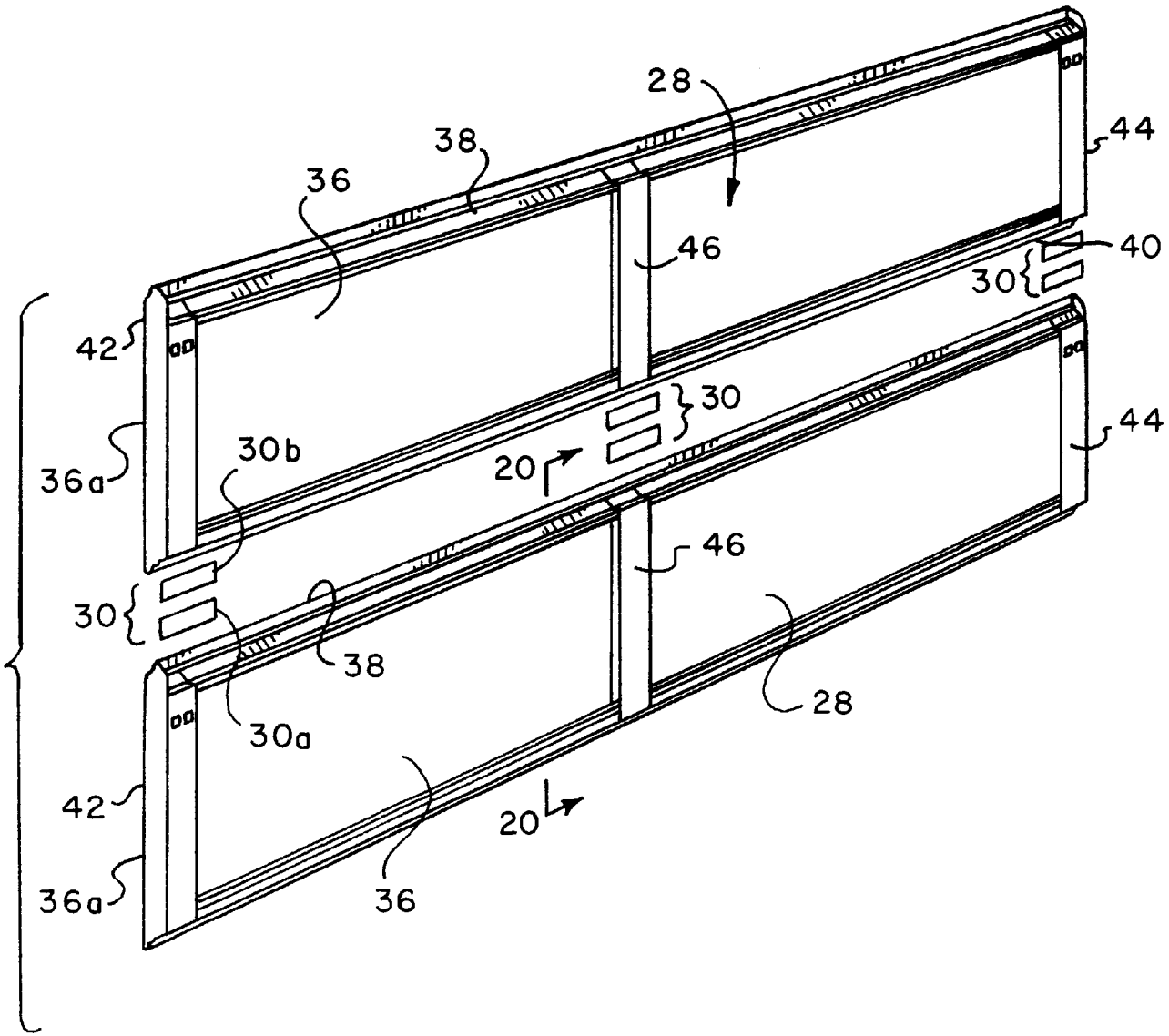
FIG. 2 is an exploded perspective view of two of the sectional door panels for the door shown in FIG. 1.

Referring briefly to FIG. 2, two adjacent panels 28 are shown in exploded perspective. Each of the panels 28 includes a rolled or otherwise formed metal or plastic panel member or so called skin part 36 forming an outward facing wall 36*a*. Skin part 36 includes a longitudinal upper edge 38 and a substantially parallel longitudinal lower edge 40. The edges 38 and 40 are contoured in such a way that when the lower edge 40 of one panel 28 cooperates with the upper edge 38 of an adjacent panel, a relatively small gap is formed between the edges when the door is moving between open and closed positions. The geometry of the edges 38 and 40 is illustrated in some detail herein in the accompanying drawings and is described in further detail in U.S. patent application Ser. No. 09/570,618 filed on May 15, 2000 and assigned to the assignee of the present invention. The subject matter of U.S. patent application Ser. No. 09/570,618 is incorporated herein by reference.

The panel parts 36 are strengthened by opposed end structural members or stiles 42 and 44 which are preferably of identical construction, but are of the opposite "hand", or otherwise characterized as mirror images of each other. The panels 28 are also strengthened by one or more intermediate stiles or structural members 46, one shown for each panel. The stiles 42, 44 and 46 are also preferably fabricated of formed metal sheet or molded or extruded plastic construction and extend generally between the upper and lower edges 38 and 40 of the panels 28 and are secured thereto in a unique manner as will be explained in further detail herein. Still further, the panels 28 are interconnected by plural spaced apart hinge assemblies 30 which include hinge members 30*b* connected to the lower edge 40 of each panel, except the lowermost panel, and hinge members 30*a* connected to the upper edge 38 of each panel except the uppermost panel.

Figure 3:
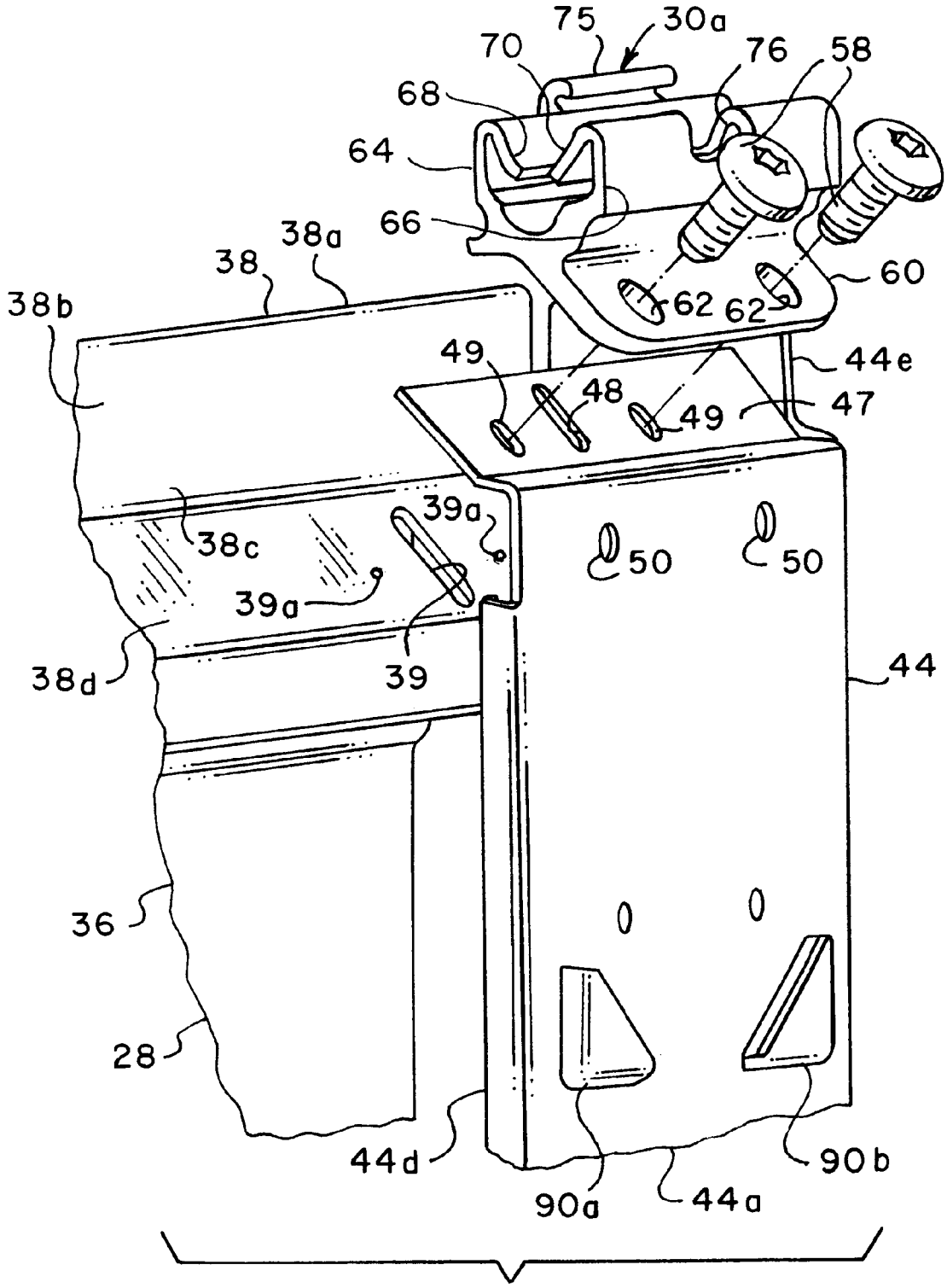
FIG. 3 is a detail, exploded perspective view showing a portion of a panel skin part at the upper edge, the upper edge of an end stile and one of the hinge parts for a hinge assembly.
Figure 4:
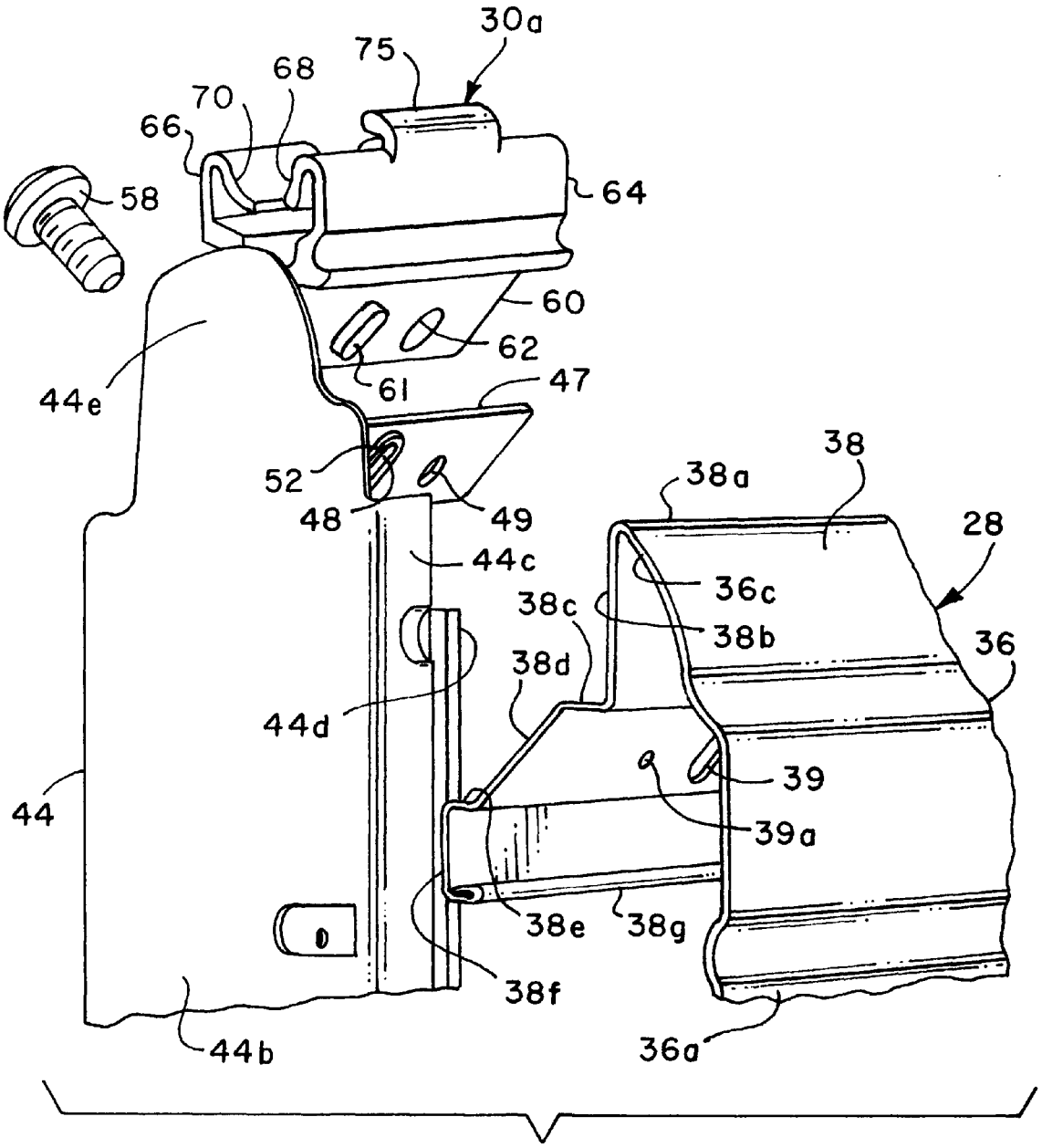
FIG. 4 is a detail perspective view similar to FIG. 3 but taken from a viewing angle substantially opposite the viewing angle of FIG. 3.
Figure 17:
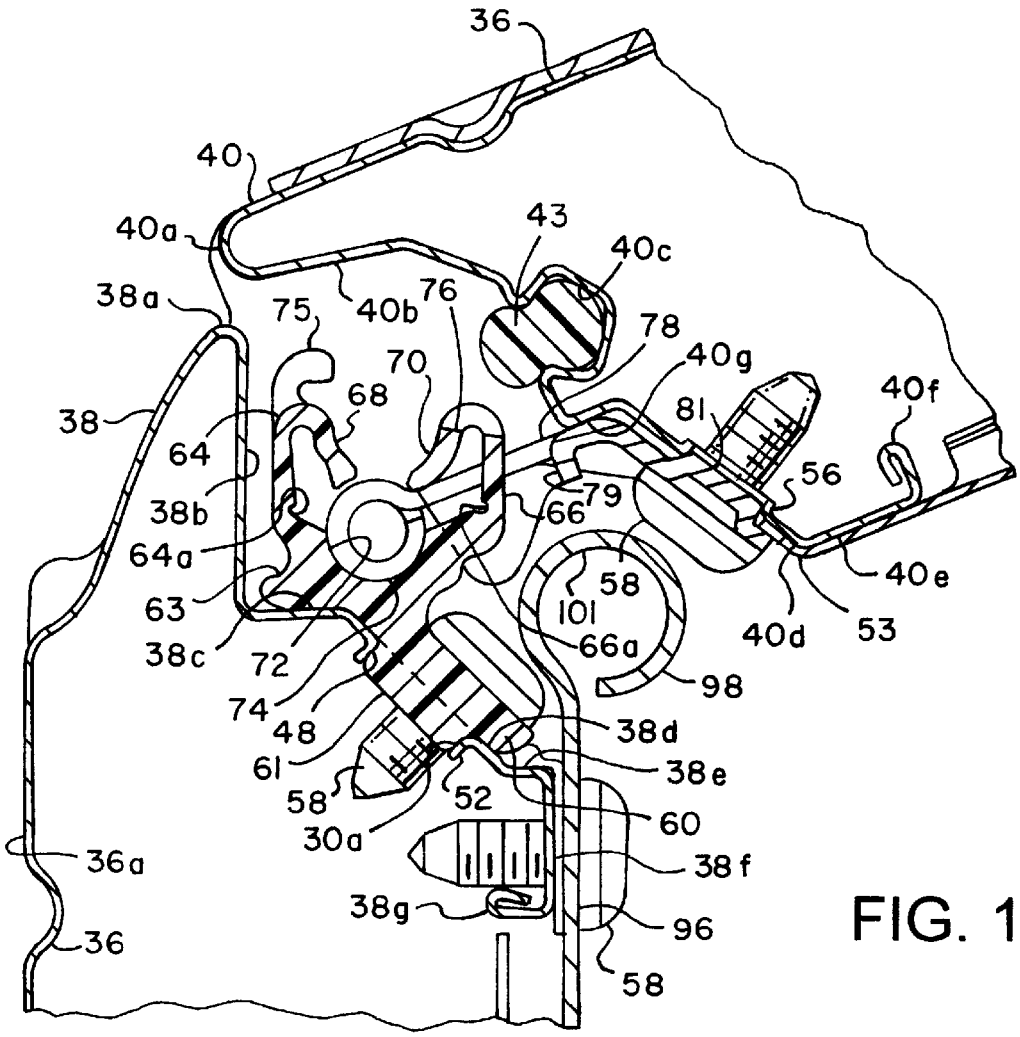
FIG. 17 is a detail section view taken from the line 17—17 of FIG. 16 with the door panels rotated relative to each other to substantially the maximum angle encountered when the door moves between open and closed positions.

For example, referring to FIGS. 3 and 4, a portion of the upper right corner of a panel 28 is shown, including the skin part 36 and the upper edge 38. Upper edge 38 includes an arcuate tip 38*a*, a generally vertically extending planar part 38*b*, a short horizontal shelf part 38*c* and a downwardly inclined face 38*d*. Still further, upper edge 38 includes a second generally horizontal shelf part 38*e*, see FIG. 17 also, and a depending inner wall part 38*f* which terminates in an inturned and curled edge 38*g*, as also shown in FIGS. 4 and 17. Inclined face 38*d* includes spaced apart elongated slots 39, one shown in FIGS. 3 and 4, formed therein and disposed between suitable fastener pilot holes or indentations 39*a*, one set shown in FIG. 3 also.

Figure 5:
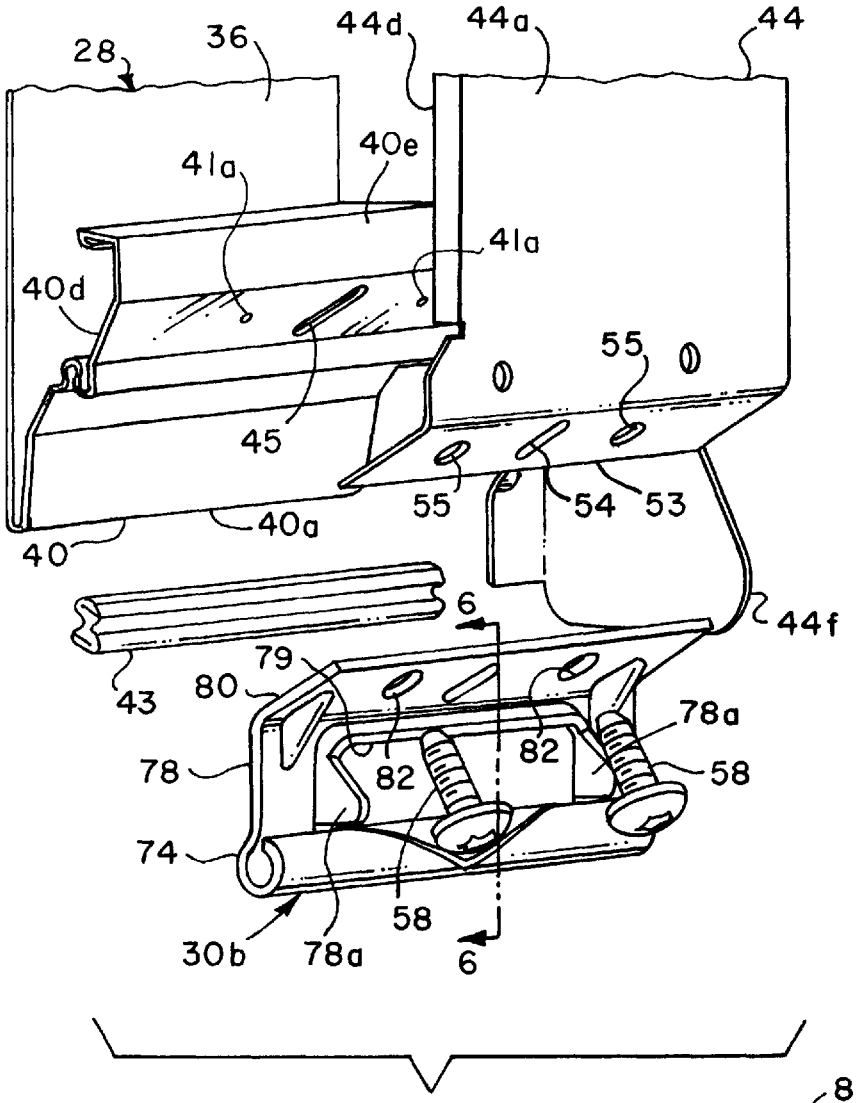
FIG. 5 is a detail, exploded perspective view of the lower edge of the door panel shown in FIGS. 3 and 4, including the lower edge of the end stile and the other hinge part of a hinge assembly.

Referring now to FIG. 5, the lower edge 40 of panel 28 includes an arcuate tip 40*a*, see FIG. 17 also, and upwardly extending somewhat concave and faceted surface or face 40*b*, a seal strip receiving groove 40*c*, FIG. 17, an inclined face 40*d* joined to an upwardly extending inner wall surface 40*e* which terminates in an inturned rolled flange 40*f*, as also shown in FIG. 17. Lower panel edge 40 includes spaced apart elongated slots 45, one shown in FIG. 5, each extending across the face 40*d*. Spaced apart fastener pilot holes 41*a* are formed in face 40*d* on opposite sides of each slot 45, as shown by way of example in FIG. 5. An elongated elastomeric seal member 43, FIGS. 5 and 17, is adapted to be retained in groove or recess 40*c*, FIG. 17, for engagement with convex tip 38*a* when adjacent door panels 28 are in closed and generally parallel positions with respect to each other.

Referring further to FIGS. 3, 4 and 5, end stile 44 is shown to comprise a formed metal plate member having a somewhat right angle or L cross sectional shape with an elongated rearwardly facing flange 44*a*, an outwardly facing flange 44*b*, FIG. 4, and a short inturned flange 44*c*, as also shown in FIG. 4. A second and relatively short edge flange 44*d*, FIGS. 3 and 5, is formed integral with the flange 44*a*. The upper end of flange 44*b* comprises a contoured part designated by numeral 44*e* to provide a closure over the gap between adjacent panels 28 when the panels are joined to each other by the aforementioned hinge assemblies 30 and rotated relative to each other out of a common plane. The lower edge of flange 44*b* is provided with a laterally displaced shield part 44*f*, see FIG. 13 also, which cooperates with the shield part 44*e* of the flange 44*b* of the stile 44 of an adjacent panel 28 to maintain a closure over the gap between the panels when they are moving between door open and closed positions.

Figure 10:
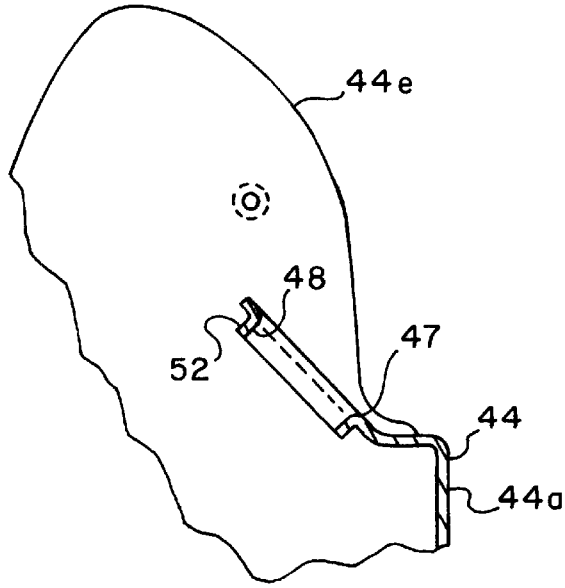
FIG. 10 is a detail section view taken from the line 10—10 of FIG. 8.

Referring again to FIGS. 3 and 5, the upper end of flange 44*a* terminates at a generally inclined flange part 47 including an elongated slot 48 formed therein. Slot-like fastener receiving openings 49 are formed on each side of slot 48, as shown in FIGS. 3 and 4. Additional fastener receiving openings 50, FIG. 3, are formed in flange 44*a* adjacent the part 47. As shown in FIG. 4, and also FIG. 10, the slot 48 is delimited by a locating feature comprising a peripheral flange 52 which extends normal to the flange end part 47 of flange 44*a* and is dimensioned to be received in a slot 39 of panel skin part 36 for substantially precisely locating the position of the end stile 44 with respect to the skin part 36 when the two parts are assembled to each other.

Figure 11:
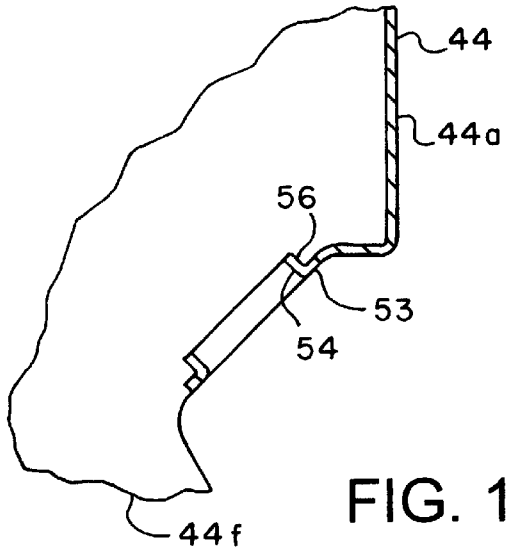
FIG. 11 is a detail section view taken from the line 11—11 of FIG. 8.

Referring further to FIGS. 5 and 11, the lower end 53 of flange 44*a* is inclined inwardly toward the skin part 36. Flange end part 53 is also formed to have an elongated slot opening 54 therein and disposed between spaced apart fastener receiving openings 55, FIG. 5. The elongated slot opening 54 is also formed by displacing material to define a locating feature comprising a peripheral flange 56, see FIG. 11, and this flange is dimensioned to fit within a cooperating slot 45 formed in lower edge face 40*d* of skin part 36. Accordingly, a stile 44 may be precisely located and assembled to a preformed panel skin part 36 by disposing the flanges 52 and 56 in the respective slots 39 and 45. The end stile 44 may be secured to the skin part 36 at the upper and lower edges 38 and 40 by conventional self tapping mechanical threaded fasteners 58, FIGS. 3 and 5.

As also shown in FIGS. 3 and 5, respective hinge parts 30*a* and 30*b* of each hinge assembly 30 are adapted to be secured to a panel 28 at the respective flange end parts 47 and 53, also by fasteners 58, and as also shown in FIG. 17.

Referring to FIGS. 3, 4 and 17, hinge part 30*a* includes a generally planar base 60 having a locating feature comprising a somewhat elongated boss 61, FIGS. 4 and 17, projecting therefrom and shaped to fit snugly within the slot 48 in the flange end part 47. In this way the hinge part 30*a* may also be located rather precisely with respect to the panel 28 when the end stile 44 is assembled to the skin part 36 and the flange 52 is located in slot 39. Referring to FIG. 3, registration of the boss 61 in slot 48 also aligns spaced apart fastener receiving holes 62 in the base part 60 with the fastener receiving holes 49 and the pilot holes or indentations 39*a* so that the fasteners 58 may be easily driven to secure the hinge part 30*a* to end stile 44 and the skin part 36 and also, of course, secure the end stile 44 to the skin part 36.

Referring further briefly to FIG. 17, hinge part 30*a* includes a secondary base portion 63 contiguous with base 60 but extending at an acute angle with respect thereto. Base parts 60 and 63 are operable to be forcibly engaged with shelf 38*c* and inclined face 38*d* which also aids in locating and supporting hinge part 30*a*. Base parts 60 and 63 are adapted to be integral with spaced apart upwardly extending deflectable sidewalls 64 and 66 of hinge part 30*a* which are contiguous with hinge pin retainer fingers 68 and 70, respectively. Retainer finger 68 and 70 cooperate with an arcuate recess 72 formed in hinge part 30*a* to form a pin receiving bore for receiving a hinge pin 74, FIG. 17, which is integrally formed as part of hinge part 30*b*. Finger 68 and 70 may be elastically deflected to allow the hinge pin 74 to move into the bore 72 and retain the hinge pin in the bore. Notches 64*a* and 66*a*, FIG. 17, at the junctures of sidewalls 64 and 66 with base parts 63 and 60 facilitate deflection of fingers 68 and 70 without undue stress thereon. Alternatively, as shown in FIGS. 3, 4 and 17, a laterally projecting tang 75 is formed on upstanding sidewall 64 for receiving a screwdriver tip and whereby the shank of such screwdriver, not shown, may register in a slot 76 in sidewall 66 whereby the fingers 68 and 70 may also be deflected to allow insertion of or removal of the hinge pin 74 with respect to the recess or bore 72.

Figure 6:
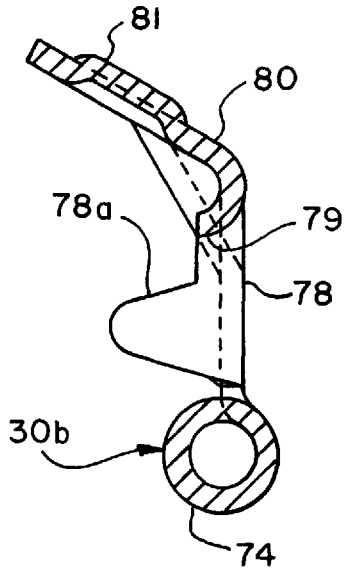
FIG. 6 is a section view taken from the line 6—6 of FIG. 5.

Referring briefly to FIGS. 5, 6 and 17, hinge part 30*b*, including the integral pin 74, is further characterized by an upstanding planar plate part 78 which is contiguous with a flange 80 extending at an acute angle with respect to the plate part. An elongated generally rectangular opening 79 is formed in plate part 78 to provide clearance for sidewalls 64 and 66 and fingers 68 and 70, see FIGS. 16 and 17 also. As shown in FIGS. 5 and 6, flange 80 includes a locating feature comprising a somewhat elongated boss 81 projecting therefrom and disposed between fastener receiving openings or slots 82, FIG. 5, for receiving fasteners 58. Accordingly, hinge part 30*b* may be easily positioned with respect to the flange end part 53 whereby the boss 81 may register in the slot 54, FIG. 5, to precisely locate the hinge part 30*b* with respect to the stile 44 and the skin part 36 as these parts are being assembled and secured to each other by the fasteners 58.

As shown in FIGS. 5 and 17, fasteners 58 are adapted to secure the hinge part 30*b* to the lower flange face 53 of stile 44 and the stile 44, in turn, is secured to the inclined face 40*d* of skin part 36, whereby the lower end of the stile 44 and the hinge part 30*b* are accurately positioned and secured in assembly with the skin part 36. In this way a hinge part 30*b* on one panel 28 may be precisely located with respect to a cooperating hinge part 30*a* on an adjacent panel 28 so that when the hinge parts are snapped together by inserting the pin 74 into the bore 72 between the fingers 68 and 70, the panels 28 are accurately positioned with respect to each other and provide for proper positioning of panels 28 during assembly of the door 22.

Referring briefly again to FIGS. 5 and 6, the hinge part 30*b* is also provided with spaced apart laterally projecting retainer tabs 78*a* which assist in retaining the panels 28 positioned laterally with respect to each other when they are assembled. The tabs 78*a* are disposed outboard of opposite end faces of the sidewalls 64 and 66 and fingers 68 and 70 and are engageable therewith so that the tabs 78*a* substantially retain the panels 28 from shifting laterally with respect to each other.

Figure 7:
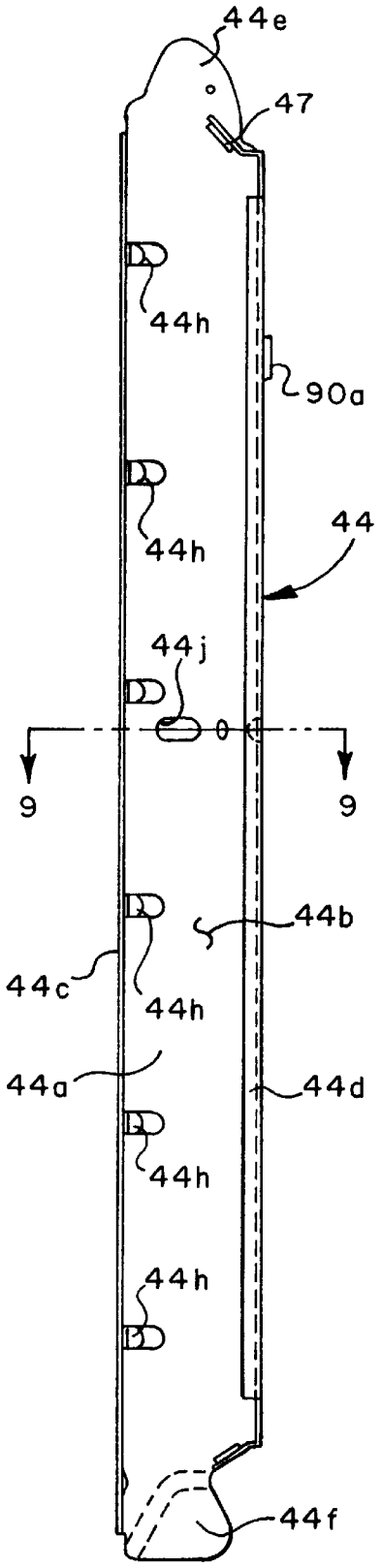
FIG. 7 is a side elevation of the stile shown in FIGS. 3, 4 and 5.
Figure 8:
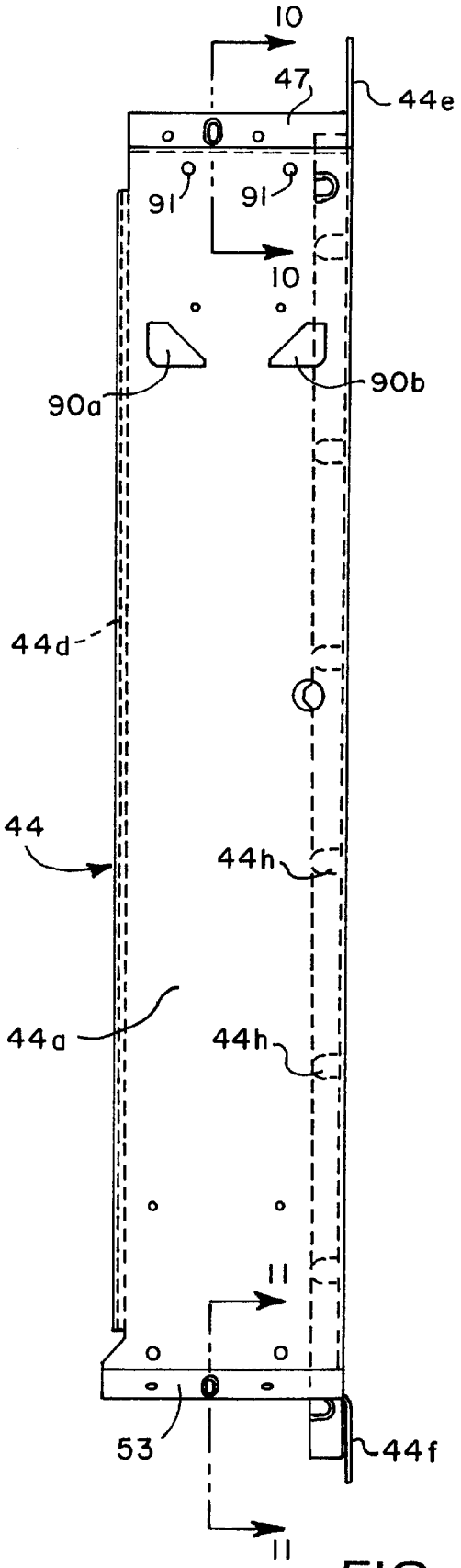
FIG. 8 is a front elevation of the stile shown in FIG. 7.
Figure 9:
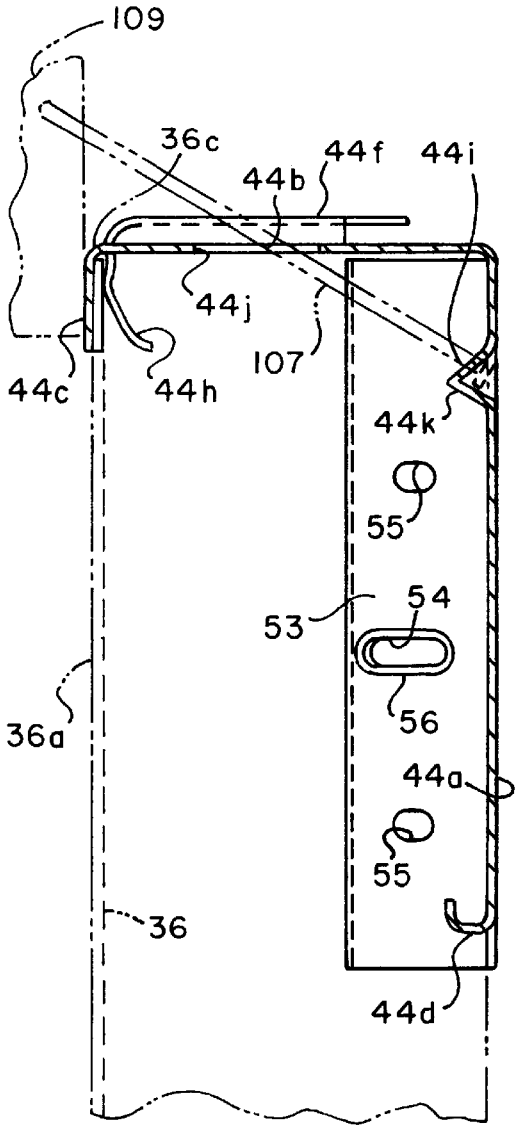
FIG. 9 is a section view taken from the line 9—9 of FIG. 7.

Referring to FIGS. 7, 8 and 9, the stile 44 is further characterized by a plurality of spaced apart retainer clips 44*h*, FIGS. 7 and 9, which are formed in the flange 44*b* by a coining or punching operation to displace metal from the flange 44*b* and to form a narrow channel between each of the clips 44*h* and the flange 44*c*, as shown in FIG. 9, for receiving a lateral edge 36*c* of the skin part 36. Accordingly, the flange 44*c* may be placed against the outer face 36*a* of the skin part 36 at edge 36*c* and the stile 44 rotated somewhat in a clockwise direction, viewing FIG. 9, while also moving the stile downwardly, viewing FIG. 9, to slide the edge 36*c* of the skin part 36 into the slots or channels formed between the flange 44*c* and the clips 44*h* until the flanges 52 and 56 move into the slots 39 and 54, respectively. Accordingly, the stile 44 may be essentially snapped into position with respect to the skin part 36. This operation is followed by locating the hinge parts 30*a* and 30*b* with respect to the panel 28 and then securing the hinge parts and the stile 44 to the skin part 36 with fasteners 58.

Referring further to FIGS. 7 and 8, the end stile 44 is also provided with spaced apart retainer tabs 90*a* and 90*b* formed in the flange 44*a* near the upper end defined by the flange part 47 and below fastener receiving pilot holes 91. The retainer tabs 90*a* and 90*b* are formed by displacing material of the flange 44*a* outwardly so that slots are formed between the tabs 90*a* and 90*b* and the outer surface of the flange 44*a*. The retainer tabs 90*a* and 90*b* are operable to locate and retain a guide member support bracket supported on the end stile, as shown in FIG. 16.

Figure 16:
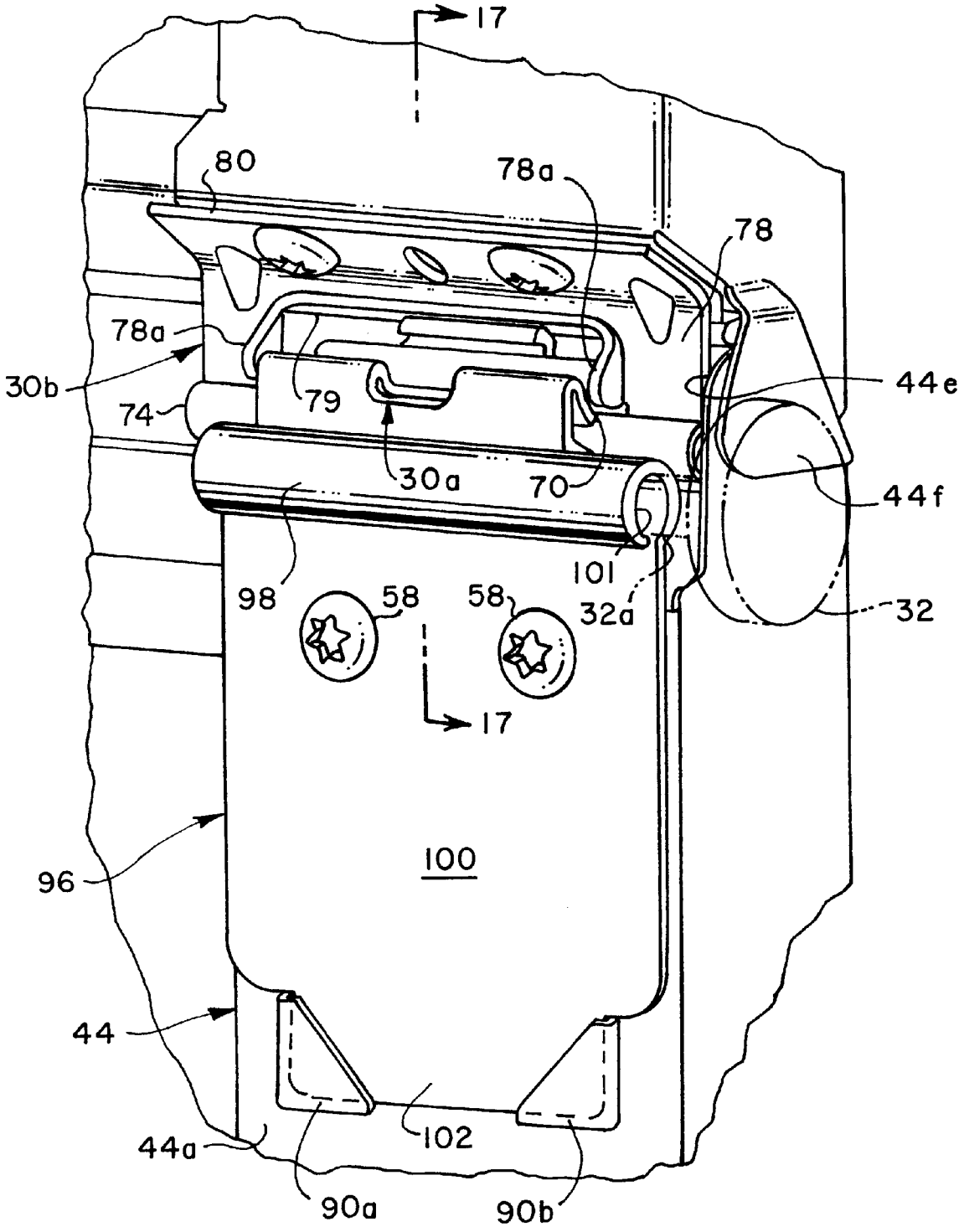
FIG. 16 is a detail perspective view showing two door panels connected by one of the hinge assemblies of the present invention.
Figure 18:
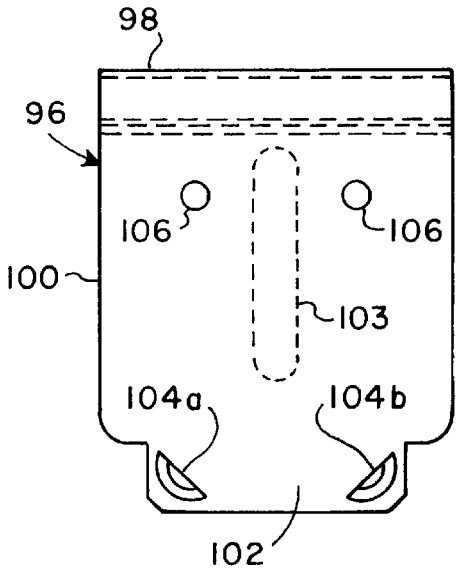
FIG. 18 is a front elevation of a guide member support bracket shown also in FIG. 16.
Figure 19:
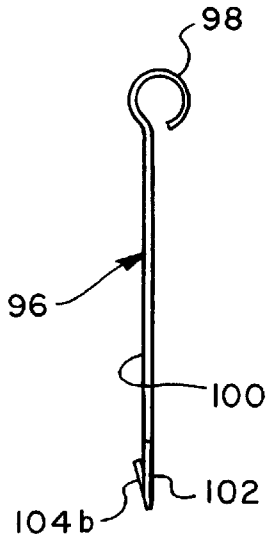
FIG. 19 is a side elevation of the guide member support bracket shown in FIG. 18.

Referring to FIGS. 16, 18 and 19, a guide member support bracket 96 is illustrated comprising an elongated generally rectangular flat plate part 100 and a roll formed integral tubular portion 98 at the upper end thereof. The roll formed tubular portion 98 defines a bore 101, FIG. 16, for receiving and supporting the shaft 32*a* of a roller-type guide member 32, for example. As shown in FIGS. 16 and 18, the plate part 100 includes a reduced width section 102 which fits between the tabs 90*a* and 90*b* and is supported thereby. The plate section 102 includes coined bosses 104*a* and 104*b*, see FIGS. 18 and 19, formed thereon to provide a slight interference fit with the tabs 90*a* and 90*b* when the bracket 96 is inserted between the tabs and the surface of the flange 44*a*. Suitable threaded fasteners 58, such as self tapping metal screws, are operable to secure the bracket 96 to the flange 44*a* of end stile 44 as shown in FIG. 16. Suitable fastener receiving holes 106, FIG. 18, are formed on the plate part 100 for receiving the fasteners 58 and the fasteners are self tapped into pilot holes 91, FIG. 8, formed in the end stile 44. Guide member support brackets are mounted on each of the panels 28 on opposite sides thereof, respectively. The position of the shaft rceiving tubular portion of each bracket, with respect to the plate part, may be adjusted to accommodate the slope of the guide tracks with respect to the door jamb. The uppermost panel 28 includes a modified guide member support bracket to be described in further detail herein.

Referring again to FIGS. 7 and 9, the flange 44*b* of end stile 44 includes an elongated slot 44*j* formed therein approximately midway between the top and bottom flange end parts 44*e* and 44*f*. Slot 44*j* is substantially coplanar with a recessed part 44*k*, FIG. 9, in flange 44*a* and having an opening 44*l* formed therein and aligned with the slot 44*j*. The opening 44*l* and slot 44*j* are adapted to receive an elongated fastener, such as a nail or screw 107, FIG. 9, which may be used to secure a door panel 28 to an adjacent door jamb 109 during installation or repair of the door 22. For example, when a panel 28 is erected adjacent a door opening, the panel may be temporarily retained in position covering the opening by inserting an elongated fastener as mentioned above through the opening 44*l* and the slot 44*j* into the door jamb, if the door jamb is fabricated of wood or plastic or another composition receptive to nail or screw type fasteners. A similar slot and opening configuration is formed in the opposite end stile 42 for securing the opposite end of the panel 28 to the opposite portion of the door jamb.

All of the discussion hereinbefore regarding the end stile 44 and the panel 28 is applicable for the end stiles 42 and the opposite end of the panels. In other words, the configuration of the end of the panel 28 to which the end stile 42 is fastened and the end stile 42 are identical to that just described for the panel 28 and stile 44, but comprise mirror images or parts of the opposite hand. The hinge parts 30*a* and 30*b* are, of course, the same for use with the end stiles 42 and the opposite end of a panel 28. Accordingly, a detailed description of end stile 42, the way in which it is attached to a panel 28 and the way in which the hinge members 30*a* and 30*b* and a guide member support bracket 96 are attached to the opposite end of a panel 28 is not believed to be necessary to understand the present invention.

Figure 12:
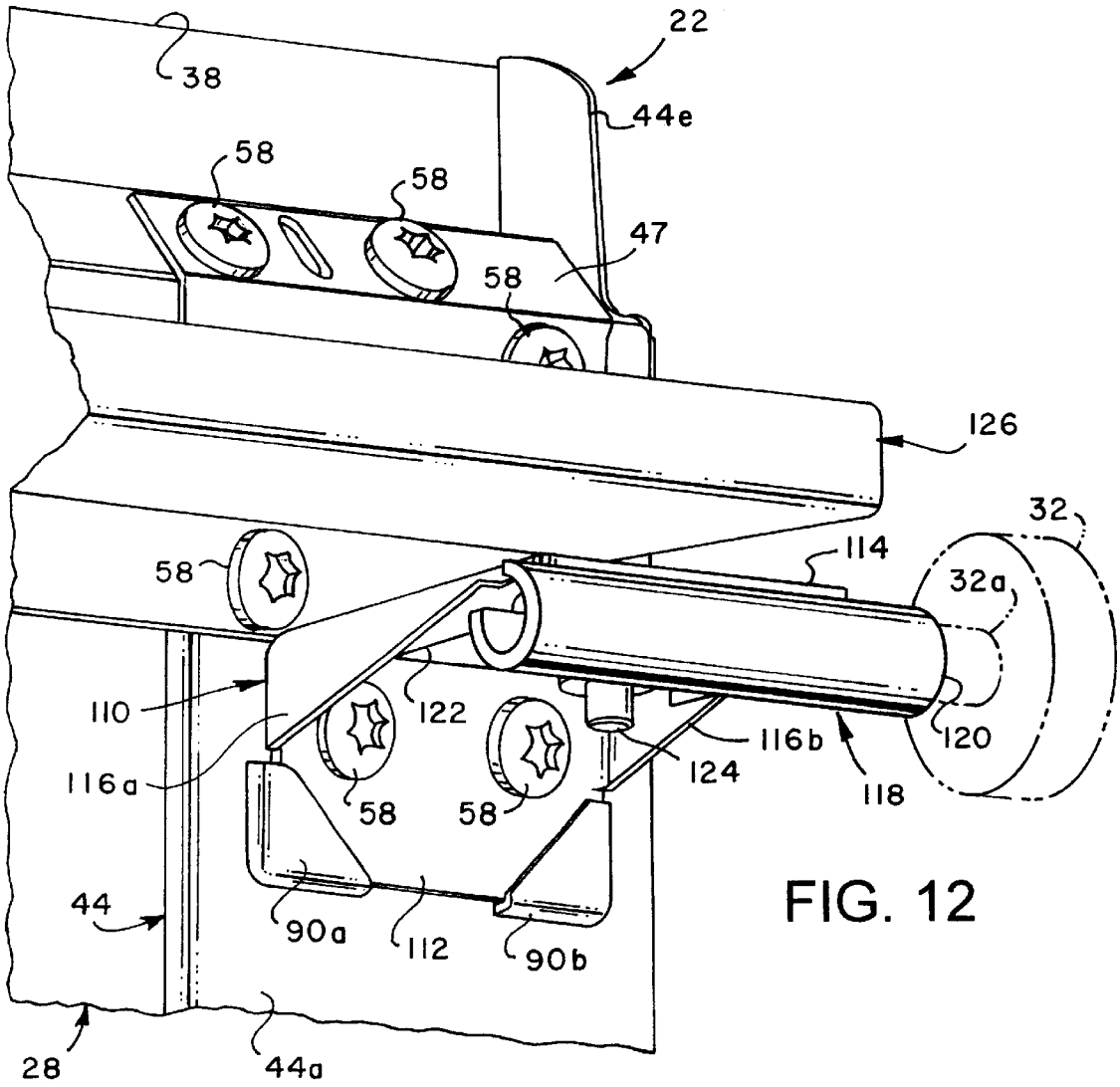
FIG. 12 is a detail perspective view of part of the upper edge of the uppermost door panel for the door shown in FIG. 1 and showing a guide member support bracket attached thereto.

Referring now briefly to FIG. 12, the upper end of the uppermost panel 28 of the door 22 is provided with a modified guide member support bracket assembly which includes a bracket member 110 having a support plate part 112 which extends substantially normal to a second support plate part 114 which is reinforced by opposed gussets 116*a* and 116*b*. Bracket assembly 110 includes an adjustable bracket part 118 including a tubular bore forming portion 120 for receiving the shaft 32*a* of a guide member 32. A planar flange part 122 is adjustably secured to the plate part 114 by suitable mechanical fasteners 124, one shown in FIG. 12. Accordingly, a bracket assembly 110 is mounted in slots in flange 44*a* formed by the tabs 90*a* and 90*b*, is secured to the end stile 44 at the flange 44*a* by fasteners 58 and supports the tubular bracket part 118 for supporting a roller 32 or similar type guide member at the upper end of the uppermost panel 28. A corresponding bracket assembly 110 is secured to the uppermost panel 28 at the panel edge opposite to that shown. As further shown in FIG. 12, an elongated panel reinforcing strut 126 may be secured across the panel 28 adjacent the upper edge 38 by fasteners 58 which are driven into forcible engagement with flange 44*a* of end stile 44. The strut 126 may, of course, be secured to the end stile 42 and the intermediate stile 46 in the same manner as described and illustrated in FIG. 12.

Figure 13:
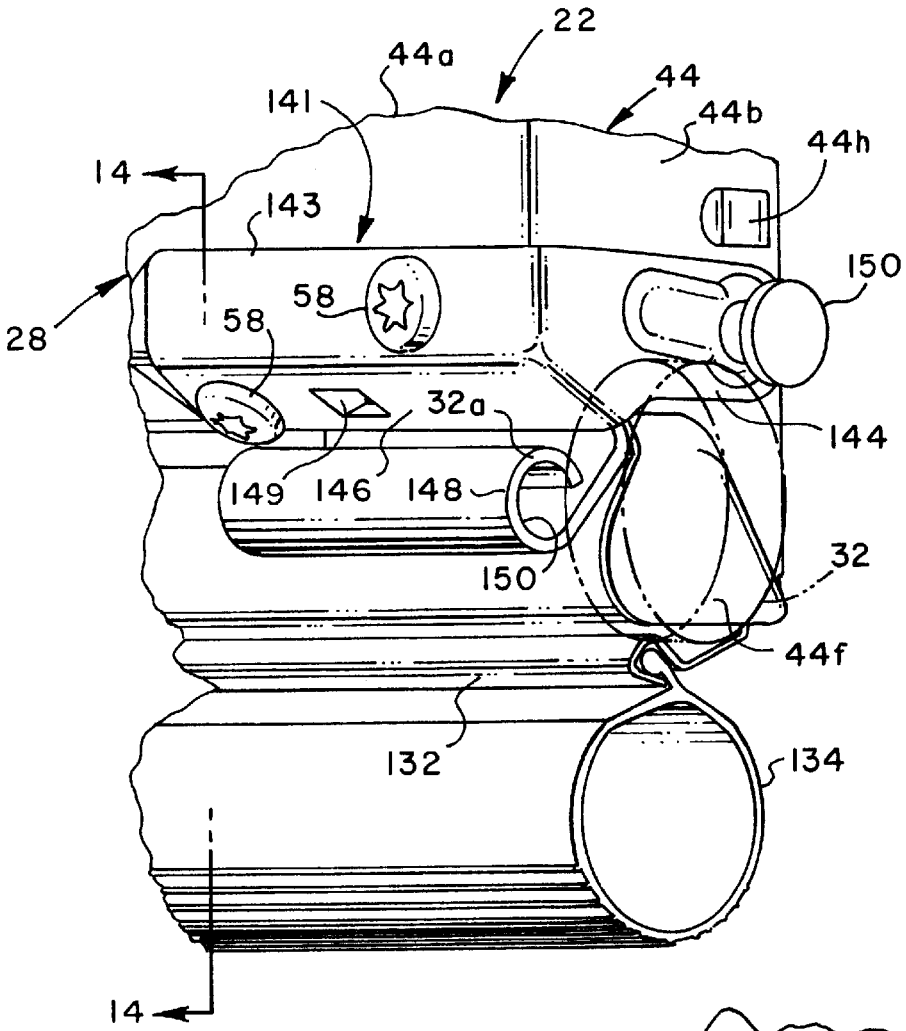
FIG. 13 is a detail perspective view of part of the lower edge of the lowermost door panel for the door shown in FIG. 1 showing certain details of a bottom bracket and a bottom edge seal or gasket.
Figure 15:
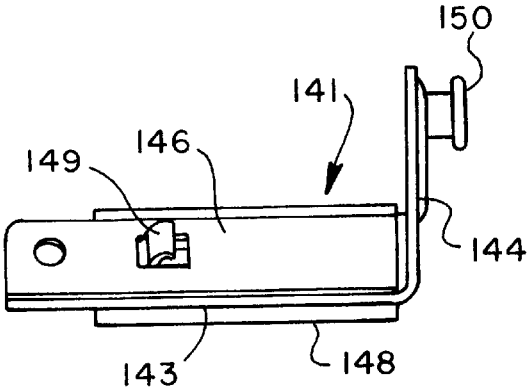
FIG. 15 is a top plan view of the bottom bracket shown in FIG. 13.
Figure 14:
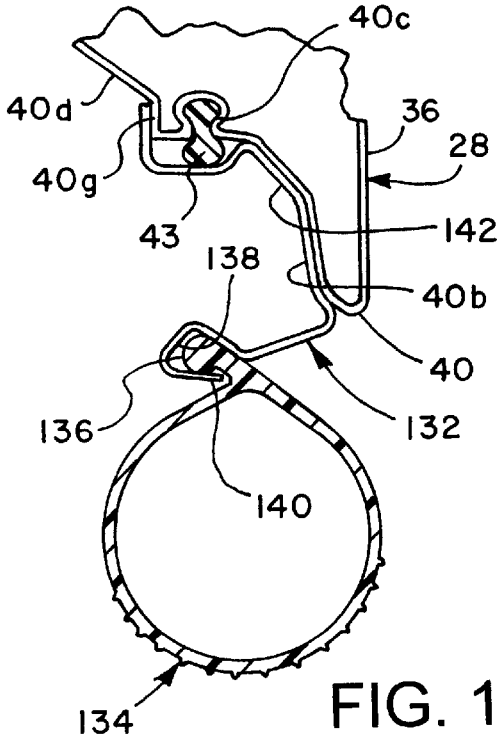
FIG. 14 is a detail section view taken from line 14—14 of FIG. 13 showing the bottom edge seal and its support member connected to the lower edge of a door panel.

FIGS. 13, 14 and 15 illustrate the configuration of the door 22 at the lower edge of the lowermost panel 28. As shown in FIGS. 13 and 14, the lower edge 40 of the lowermost panel 28 supports an elongated formed metal platelike support member 132 for an elongated elastomeric bottom edge seal 134. Bottom edge seal 134 is preferably characterized as a tubular, molded or extruded elastomer member which is elastically deflectable to form a seal between the garage floor and the bottom edge 40 of the lowermost door panel 28. The elongated tubular elastomer seal 134 includes an elongated support rib 136 which is insertable in a channel portion 138 of support member 132, see FIG. 14, wherein said channel portion is formed by a flange 140 which is folded over against the rib 136 to forcibly retain the rib connected to the support member 132. The support member 132 is shaped, at an elongated flange portion 142, to match the contour of the bottom edge 40 including contoured surfaces 40*b* and a shoulder 40*g* formed between the slot 40*c* and the inclined surface 40*d*. The support member 132 is suitably secured to the bottom edge 40 of a panel 28 by fasteners 58, for example, not shown in FIGS. 13 or 14.

Referring further to FIGS. 13 and 15, each corner of the bottom edge of the lowermost panel member 28 of the door 22 is provided with a bracket for supporting a guide member 32 and for connecting the flexible cables 33*a* and 33*b* of counterbalance mechanism 33 to the door 22. A so-called right hand bracket 141 is illustrated in FIGS. 13 and 14 by way of example. A corresponding left-hand bracket, not shown, is adapted to be secured to the bottom edge 40 of the lowermost door panel 28 at the opposite end thereof. Bracket 141 is substantially like the bracket described and claimed in U.S. patent application Ser. No. 09/552,492, filed Apr. 19, 2000, and assigned to the assignee of the present invention. The entire disclosure of application Ser. No. 09/552,492 is incorporated herein by reference.

Bottom bracket 141 includes opposed right angle flange parts 143 and 144 and an inclined flange part 146. Inclined flange part 146 is integrally formed with a tubular part 148, FIG. 13, forming a bore 150 for receiving the shaft 32*a* of a guide roller 32, or a similar guide member, for guiding the door 22 between the tracks 24 and 26. Flange 144 supports a boss 150 for connection to a becketed end of a flexible cable, such as the cable 33*b*, not shown in FIGS. 13 or 15. Bracket 141 is adapted to be secured to the lower corner of a panel 28 at end stile 44 by suitable fasteners 58 engageable with the flanges 142 and 146, as shown in FIG. 13. A bracket retaining hook 149, FIG. 15, is formed by displacing material of the flange 146, as shown, whereby the hook 149 is insertable in the slot 54 of end flange part 53 for added securement of the bracket 141 to the door panel 28.

Figure 20:
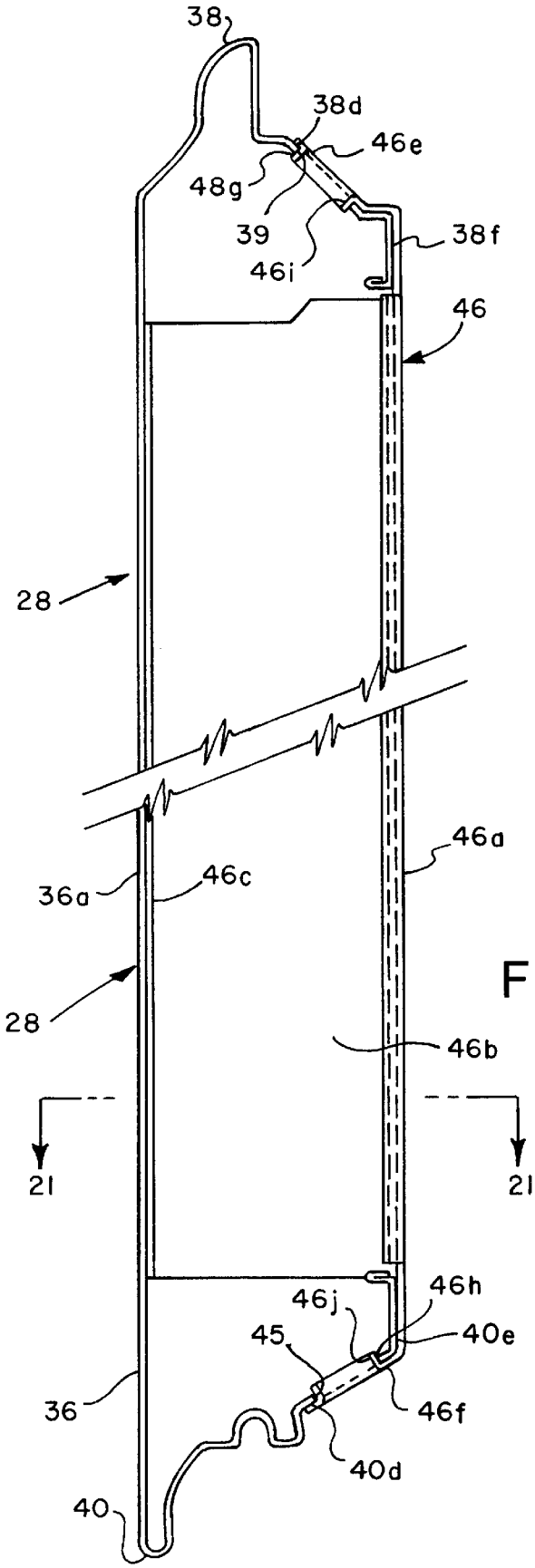
FIG. 20 is a section view taken generally from line 20—20 of FIG. 2.
Figure 21:
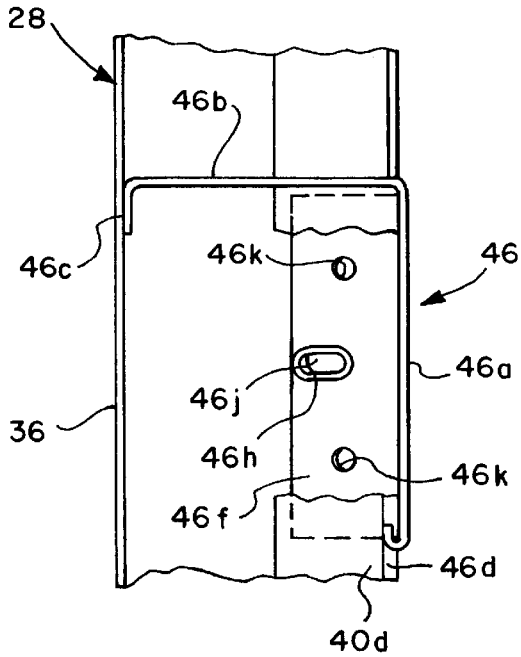
FIG. 21 is a section view taken from the line 21—21 of FIG. 20.

Referring now to FIGS. 20 and 21, a center or intermediate stile 46 is illustrated secured in its working position with respect to a door panel 28. Stile 46 is characterized by a rearwardly facing flange 46*a*, a flange 46*b* extending at right angles to flange 46*a* and terminating in a short flange 46*c* extending parallel to flange 46*a*. Flange 46*a* terminates in an inturned distal end 46*d*, FIG. 21. The opposite ends of flange 46*a* are defined by inclined flange portions 46*e* and 46*f* which are adapted to be engaged with inclined faces 38*d* and 40*d* of the respective top and bottom edges of a panel 28. Elongated slots 39 and 45 formed in the faces 38*d* and 40*d* are adapted to receive elongated oval flanges 46*g* and 46*h*, respectively, which delimit openings 46*i* and 46*j* and are formed in the same manner as the flanges 52 and 56 of the end stile 44 to provide for precisely locating the stile 46 with respect to the panel 28. The center or intermediate stile 46 is adapted to be secured to the faces 38*d* and 40*d* of the panel by fasteners 58, not shown in FIGS. 20 or 21. In this regard, the flange portions 46*e* and 46*f* may be provided with suitable fastener receiving holes or openings 46*k*, FIG. 21, by way of example.

Typically, hinge parts 30*a* and 30*b* are secured to a panel 28 at a center or selected ones of intermediate stiles 46 in the same manner that the hinge parts are secured to a panel 28 at the stiles 42 and 44. Accordingly, when a stile 46 is to be secured to a panel skin part 36, the stile is aligned with opposed slots 39 and 45 disposed intermediate the ends of the panel skin part and the flanges 46*g* and 46*h* are snapped into the slots 39 and 45 provided in the faces 38*d* and 40*d*. Hinge parts 30*a* and 30*b* are then aligned with their required locations on the panel 28 and with regard to the stiles 46 by inserting the bosses 61 and 81 in the slots 46*i* and 46*j* formed by the flanges 46*g* and 46*h* in the same manner as provided for aligning the hinge members with respect to the end of stiles. Fasteners 58 may then be used to secure the stile or stiles 46 to the panel skin part 36 in the same manner as is done for securing the hinge parts to the stiles 42 and 44 and for securing the stiles 42 and 44 to the skin part 46. In this way, the hinge assemblies 30 are prealigned since the panel skin parts 36 are prefabricated with the geometry shown and described including the slots 39 and 45 and the fastener pilot holes on opposite sides of each of the slots 39 and 45 of the inclined faces 38*d* and 40*d* of each panel.

The construction and use of the door 22 is believed to be readily understandable to those of ordinary skill in the art based on the foregoing description. However, the assembly of a panel 28 and the assembly of panels 28 to each other provide several advantages. For example, the skin part 36 may be conveniently pre-formed with slots 39 and 45 and fastener pilot holes 39*a* and 41*a* formed therein in predetermined locations between opposite side edges of the skin part. Normally, the skin part 36 is formed with the slots 39 and 45 and pilot holes 39*a* and 41*a*, for example, prepunched at selected locations into a pre-sized sheet. The skin part 36 may then be roll formed or otherwise formed to the shape shown in the drawing figures. In like manner, the stiles 42, 44 and 46 may be prefabricated to have the slots and fastener receiving holes described for each part suitably formed therein and including the skin part retaining tabs 44*h*, for example. The sheet or platelike material used to fabricate the stiles 42, 44 and 46 may then be folded into the configurations shown and described herein.

When assembling a panel 28, the end stile 44, for example, may be connected to the skin part by positioning the stile adjacent the side edge 36*c* of the skin part and inserting the side edge in the slots or channels formed between the flange 44*c* and the retaining clips or fingers 44*h* and then rotating the stile 44 slightly until the flanges 52 and 56 snap into the slots 39 and 45, respectively. In like manner, the center or intermediate stile 46 may be connected to the skin part 36 by snapping the flanges 46*g* and 46*h* into the slots 39 and 45 formed in the skin part 36 intermediate its opposite ends.

The hinge parts 30*a* and 30*b* may then be connected to the upper and lower edges 38 and 40 of each panel, respectively, by accurately positioning the hinge parts so that their respective bosses 61 and 81 register in the slots 48 and 54 of end stile 44, for example. Respective hinge parts 30*a* and 30*b* are also adapted to register in the corresponding slots formed in end stile 42 and slots 46*i* and 46*j* formed by the flanges 46*g* and 46*h* of the stile 46, for example. Fasteners 58 may then be used to secure the hinge parts 30*a* and 30*b* and the stiles 42, 44 and 46 to the skin part 36 to form the panel 28. Accordingly, those skilled in the art will appreciate that the hinge parts 30*a* and 30*b* may be accurately located on each of the door panels 28 so that the panels may be conveniently connected to each other and accurately aligned with each other when erecting the door 22.

In like manner, the guide member support brackets 96 and 110 may be conveniently mounted on the end stiles 42 and 44 by sliding the brackets into engagement with the tabs 90*a* and 90*b*, for example, and then securing the brackets to the stiles with fasteners 58. The bottom edge seal 134 may also be conveniently connected to the lowermost panel 28 at its bottom edge 40, as previously described.

The lowermost panel 28 may then be mounted between the tracks 24 and 26 at the door opening 21, FIG. 1, and temporarily secured to the door jamb, not shown, by inserting nail or screw fasteners through the opening 44*l* and 44*j*, for example, with the door panel being held in place with its spaced apart hinge members 30*a* positioned to receive the cooperating hinge members 30*b* secured to the lower edge 40 of the next panel. The panel 28 to be mounted above the lowermost panel 28 is then positioned directly above the lowermost panel and lowered into position wherein the pin part 74 of each of the hinge members 30*b* may be snapped into the pin receiving bores 72 of the hinge parts 30*b* and retained therein by the elastically deflectable fingers 68 and 70. Each panel 28 may then be mounted above the next lowest panel in the same manner to assemble the door 22.

The panels 28, including the hinge parts 30*a* and 30*b*, the skin parts 28 and the stiles 42, 44 and 46 may be formed of materials known to those skilled in the art of sectional doors. Foldable metal plate can be used for the skin parts 36 and the stiles 42, 44 and 46. Folded or extruded plastic materials may also be used for these parts. Hinge parts 30*a* may be formed of moldable or extrudable plastic materials and hinge parts 30*b* may be formed of metal or plastic materials and are preferably formed of rolled and stamped metal plate as described in patent application Ser. No. 09/570,618. The other components described herein may also be fabricated of conventional engineering materials for sectional doors and the like.

Although preferred embodiments of the invention have been described in detail herein, those skilled in the art will recognize that various substitutions and modifications may be made without departing from the scope and spirit of the appended claims.

What is claimed is:

1. A sectional door panel comprising:

a skin part including an elongated front face and opposed top and bottom edges;

spaced apart stiles adapted to connect to said skin part at said top and bottom edges, at least one of said stiles comprising top and bottom flange portions, said top and bottom flange portions each including a locating surface formed thereon and respectively engageable with a cooperating locating feature, formed on said top and bottom edges, situating said at least one stile with respect to said skin part, and at least one said edges includes spaced-apart slots formed therein and defining said locating feature on said one edge of said skin part.

2. The door panel set forth in claim 1 wherein:

at least one of said flange portions of said stiles includes projections formed thereon, respectively, and registrable with said slots formed in said one edge of said skin part for locating said stiles with respect to said skin part.

3. A method for assembling a door panel for a sectional door comprising the steps of:

providing a panel skin part including an elongated front face and opposed top and bottom edges, said top and bottom edges including spaced apart stile locating openings formed therein, respectively;

providing opposed end stiles engageable with said skin part at opposite side edges of said skin part, respectively, each of said stiles including opposed flange portions including a locating surface formed thereon, respectively, and engageable with said locating openings formed on said opposed edges of said skin part, respectively;

providing opposed hinge parts for connection to said panel adjacent said opposed edges of said skin part, said hinge parts each including a locating boss thereon adapted to be engageable with hinge part locating openings in said end stiles, respectively;

positioning said end stiles adjacent to said edges of said skin part, respectively, and registering said locating surfaces of said stiles in engagement with said skin part at said openings to position said end stiles with respect to said skin part;

engaging said locating bosses on said hinge parts with said locating openings on said end stiles; and securing said hinge parts and said end stiles to said skin part.

4. The method set forth in claim 3 including the step of:

securing said hinge parts and said end stiles to said skin part with mechanical fasteners, respectively.

5. The method set forth in claim 3 including the step of:

providing said end stiles with spaced apart clips formed thereon and defining narrow slots between said clips and a flange portion of said end stiles, respectively; and inserting side edges of said skin part in said slots to aid in securing and locating said end stiles with respect to said skin part, respectively.

6. The method set forth in claim 3 including the steps of:

providing said end stiles with spaced apart openings formed in opposed flanges thereof;

positioning said panel adjacent a door jamb; and temporarily securing said panel to said door jamb with elongated fasteners projecting through said openings in said end stiles, respectively.

7. The method set forth in claim 6 including the steps of:

providing multiple door panels adapted to form a sectional door, each of said door panels including opposed hinge parts connected to said panels adjacent a top edge of one of said panels and a bottom edge of the other of said panels and moving said other panel into engagement with said one panel by engaging said hinge parts with each other, respectively, to complete the connection of said panels to each other.

8. A sectional door panel comprising:

a skin part including an elongated front face and opposed top and bottom edges;

spaced apart stiles adapted to connect to said skin part at said top and bottom edges, at least one of said stiles comprising top and bottom flange portions, said top and bottom flange portions each including a locating surface formed thereon and respectively engageable with a cooperating locating feature, formed on said top and bottom edges, situating said at least one stile with respect to said skin part;

opposed hinge parts adapted to connect to said panel adjacent said top and bottom edges, respectively, in predetermined positions on said top and bottom edges, each of said hinge parts comprising a locating feature formed thereon and respectively engageable with a cooperating locating feature, formed on said top and bottom edges, thereby situating said hinge parts in predetermined positions on said panel; and said locating feature on at least of one of said hinge parts comprises a boss projecting from a mounting face of said one hinge part and disposed in a slot formed in one of said skin part and said at least one stile.

9. The door panel set forth in claim 8 wherein:

said mounting face includes fastener receiving openings formed therein for receiving fasteners to secure said hinge part to said panel in said predetermined position.

10. A sectional door panel comprising:

a skin part including an elongated front face and opposed top and bottom edges;

spaced apart stiles adapted to connect to said skin part at said top and bottom edges, at least one of said stiles comprising top and bottom flange portions, said top and bottom flange portions each including a locating surface formed thereon and respectively engageable with a cooperating locating feature, formed on said top and bottom edges, situating said at least one stile with respect to said skin part;

opposed hinge parts adapted to connect to said panel adjacent said top and bottom edges, respectively, in predetermined positions on said top and bottom edges, each of said hinge parts comprising a locating feature formed thereon and respectively engageable with a cooperating locating feature, formed on said top and bottom edges, situating said hinge parts in predetermined positions on said panel; and one of said hinge parts comprises a hinge pin and the other of said hinge parts comprises a pin receiving bore, said bore being defined in part by elastically deflectable fingers for receiving said pin of said one hinge part for registration in said bore and for retaining said pin in said bore.

11. A sectional door panel comprising:

a skin part including an elongated front face and opposed top and bottom edges;

spaced apart stiles adapted to connect to said skin part at said top and bottom edges, at least one of said stiles comprising top and bottom flange portions, said top and bottom flange portions each including a locating surface formed thereon and respectively engageable with a cooperating locating feature formed on said top and bottom edges, situating said at least one stile with respect to said skin part; and said at least one stile includes spaced-apart clips formed thereon and positioned adjacent a flange of said at least one stile to form a plurality of spaced-apart slots for receiving a side edge of said skin part, respectively.

12. A sectional door panel comprising:

a skin part including an elongated front face and opposed top and bottom edges;

spaced apart stiles adapted to connect to said skin part at said top and bottom edges, at least one of said stiles comprising top and bottom flange portions, said top and bottom flange portions each including a locating surface formed thereon and respectively engageable with a cooperating locating feature, formed on said top and bottom edges, situating said at least one stile with respect to said skin part; and a flange of said at least one stile includes spaced-apart retaining tabs formed thereon for receiving a guide member support bracket for supporting said bracket on said at least one stile.

13. A sectional door panel comprising:

a skin part including an elongated front face and opposed top and bottom edges;

spaced apart stiles adapted to connect to said skin part at said top and bottom edges, at least one of said stiles comprising top and bottom flange portions, said top and bottom flange portions each including a locating surface formed thereon and respectively engageable with a cooperating locating feature, formed on said top and bottom edges, situating said at least one stile with respect to said skin part; and at least one bottom edge bracket adapted to be secured to said skin part and including a hook part engageable in a slot formed on said flange on said at least one stile when said bracket is secured to said door panel at said bottom edge.

14. A sectional door panel comprising:

a skin part including an elongated front face and opposed top and bottom edges;

spaced apart end stiles and at lease one intermediate stile adapted to connect to said skin part at said top and bottom edges, said stiles each comprising opposed top and bottom flange portions, said top and bottom flange portions each including a locating surface formed thereon and respectively disposed in spaced apart slots formed in said top and bottom edges, respectively, situating said stiles with respect to said skin part;

each of said opposed flange portions on each of said stiles includes spaced apart fastener receiving holes formed therein and disposed on opposite sides of said locating surfaces, respectively; and said locating surfaces formed on said opposed flange portions comprise elongated slots delimited by peripheral flange portions extending normal to said opposed flange portions, respectively.

15. The door panel set forth in claim 14 including:

opposed hinge parts operable to be connected to said panel adjacent said top and bottom edges, respectively, each of said hinge parts including a locating boss formed thereon for registration with said slots delimited by said peripheral flange portions on said respective stiles for locating said hinge parts in predetermined positions on said panel.

16. A method for assembling a door panel for a sectional door comprising the steps of:

providing a panel skin part comprising an elongated front face and opposed top and bottom edges, said top and bottom edges each including a plurality of spaced apart stile locating features formed thereon;

providing opposed end stiles engageable with said skin part at opposite side edges of said skin part, respectively, each of said end stiles having top and bottom flange portions including a locating feature formed thereon, respectively, and engageable with said stile locating features formed on said top and bottom edges;

providing said end stiles with spaced apart clips formed thereon and defining narrow slots between said clips and a flange portion of said end stiles, respectively;

positioning said end stiles adjacent to said side edges of said skin part, respectively, and registering said locating features of said top and bottom flange portions in engagement with said stile locating features to situate said end stiles with respect to said skin part;

inserting side edges of said skin part in said slots to aid in securing and locating said end stiles with respect to said skin part, respectively; and securing said end stiles to said skin part, respectively.

17. A method for assembling a door panel for a sectional door comprising the steps of:

providing a panel skin part comprising an elongated front face and opposed top and bottom edges, said top and bottom edges each including a plurality of spaced apart stile locating features formed thereon;

providing opposed end stiles engageable with said skin part at opposite side edges of said skin part, respectively, each of said end stiles having top and bottom flange portions including a locating feature formed thereon, respectively, and engageable with said stile locating features formed on said top and bottom edges;

providing said end stiles with spaced apart openings formed in opposed flanges thereof;

positioning said end stiles adjacent to said side edges of said skin part, respectively, and registering said locating features of said top and bottom flange portions in engagement with said stile locating features to situate said end stiles with respect to said skin part;

securing said end stiles to said skin part, respectively;

positioning said panel adjacent a door jamb; and temporarily securing said panel to said door jamb with elongated fasteners projecting through said openings in said end stiles, respectively.

18. The method set forth in claim 17 including the steps of:

providing multiple door panels adapted to form a sectional door, each of said door panels including opposed hinge parts connected to said panels adjacent a top edge of one of said panels and a bottom edge of the other of said panels and moving said other panel into engagement with said one panel by engaging said hinge parts with each other, respectively, to complete the connection of said panels to each other.

19. A sectional door panel comprising:

a skin part including an elongated front face and opposed top and bottom edges;

spaced apart stiles adapted to be connected to said skin part at said top and bottom edges, said stiles each including a portion including a locating projection formed thereon, and engageable with one of said edges at a cooperating slot formed on said one edge for locating said stiles with respect to said skin part, respectively.

20. The door panel set forth in claim 19 including:

opposed hinge parts adapted to be connected to said panel adjacent said top and bottom edges, respectively, in predetermined positions on said panel, each of said hinge parts including a locating feature formed thereon for locating said hinge parts in predetermined positions on said panel.

21. A method for assembling a door panel for a sectional door comprising the steps of:

providing a panel skin part including an elongated front face and opposed top and bottom edges, said top and bottom edges including spaced apart openings forming stile locating features thereon, respectively;

providing opposed end stiles engageable with said skin part at opposite side edges of said skin part, respectively, each of said stiles including opposed flange portions each including a projection thereon forming a stile locating feature, respectively, and engageable with said locating features formed on said opposed edges of said skin part;

positioning said end stiles adjacent to said edges of said skin part, respectively, and registering said locating features of said stiles in engagement with said locating features of said skin part to positively position said end stiles with respect to said skin part; and securing said end stiles to said skin part, respectively.

22. The method set forth in claim 21 including the steps of:

providing opposed hinge parts for connection to said panel adjacent said opposed edges of said skin part, said hinge parts including a locating feature thereon adapted to be engageable with cooperating locating features on said end stiles, respectively; and attaching said hinge parts to said panel by engaging said locating features on said hinge parts with said cooperating locating features on said end stiles.

* * * * *